United States Patent [19]

Fletcher et al.

[11] 3,983,933

[45] Oct. 5, 1976

[54] HEAT EXCHANGER

[76] Inventors: James C. Fletcher, Administrator of the National Aeronautics and Space Administration, with respect to an invention of Roy F. Holmes; Edward E. Keller, both of San Diego, Calif.

[22] Filed: Nov. 5, 1974

[21] Appl. No.: 521,006

[52] U.S. Cl. ..... 165/164; 165/170

[51] Int. Cl.[2] ..... F28D 7/08

[58] Field of Search ..... 165/166 MF, 165, 76, 165/77, 166, 170

[56] References Cited

UNITED STATES PATENTS

| | | | |
|---|---|---|---|
| 2,129,300 | 9/1938 | Bichowsky | 165/76 |
| 2,131,265 | 9/1938 | Bichowsky | 165/165 |
| 2,136,086 | 11/1938 | Rosenblad | 165/166 |
| 2,136,153 | 11/1938 | Rosenblad | 165/165 |

FOREIGN PATENTS OR APPLICATIONS

| | | | |
|---|---|---|---|
| 88,277 | 7/1921 | Switzerland | 165/164 |

*Primary Examiner*—Charles J. Myhre
*Assistant Examiner*—Theophil W. Streule, Jr.
*Attorney, Agent, or Firm*—L. D. Wofford, Jr.; Gary Grafel; John R. Manning

[57] ABSTRACT

An improved lightweight heat exchanger particularly suited for use in systems having low volume flow, high longitudinal gradient and high effectiveness requirements. The heat exchanger is characterized by a shell of an annular configuration, an endless plate of minimal thickness and of a substantially uniformly convoluted configuration disposed within the annular shell for defining therewithin a plurality of endless, juxtaposed passages, each having a low Reynold's number and being of an annular configuration. A pair of manifolds disposed 180° apart is mounted on the shell in communication with the passages through which counterflowing fluids having different temperatures are simultaneously introduced and extracted from the passageways for thus achieving a continuous transfer of heat through the convoluted plate.

1 Claim, 6 Drawing Figures

HEAT EXCHANGER

ORIGIN OF THE INVENTION

The invention described herein was made in the performance of work under a NASA contract and is subject to the provisions of Section 305 of the National Aeronautics and Space Act of 1958, Public Law 85–568 (72 Stat. 435; 42 U.S.C. 2457).

BACKGROUND OF THE INVENTION

The invention generally relates to heat exchangers, and more specifically to a recuperative heat exchanger particularly suited for reducing the power required in maintaining reactive temperatures within systems utilized for the reduction of $CO_2$, through a process known as the Bosch process, aboard spacecraft and similar vehicles.

In the Bosch process $CO_2$ is catalytically reacted with $H_2$ to form water and solid carbon. In space applications, the water is electrolyzed to return $O_2$ to the crew of the spacecraft and $H_2$ is returned to the reduction unit.

The reaction of $CO_2$ with $H_2$ takes place at 1100° to 1300° F. but cannot be completed efficiently in a single pass because a water vapor equilibrium is approached. Therefore, a recylce system is preferred. Such a system normally comprises a closed loop in which the carbon can be accumulated with a catalyst cartridge for periodic removal, water vapor can be removed continuously by condensation and feed gases can enter only to replace the volume reductions due to the reaction and to water condensation and separation.

In practice, a recuperative heat exchanger is employed for reducing the power required in maintaining reactive temperatures. As can be appreciated, heat exchangers having conventional configurations are limited in effectiveness by the combination of space limitations, longitudinal temperature gradients, and recycle pumping power capabilities. A further objection to heat exchangers heretofore employed is that most of the materials utilized in the fabrication of such heat exchangers are especially catalytically active in weld areas. This, of course, results in a formation and collection of carbon which tends to block the passages of the heat exchanger, to the extent that rupture may be experienced. Moreover, in the aerospace industry, the envelope size as well as the mass of system components is of utmost concern to designers. Therefore, use of heat exchangers of conventional configurations in a space environment is impaired due to both bulk and consideration given to weight limitations.

It is therefore the general purpose of the instant invention to provide a compact, lightweight heat exchanger characterized by an increased achievable heat exchange effectiveness, and an increased operational life span.

OBJECTS AND SUMMARY OF THE INVENTION

It is an object of the instant invention to provide an improved recuperative heat exchanger.

It is another object to provide an improved counterflow heat exchanger having increased achievable heat exchange effectiveness.

It is another object to provide a single-pass, counterflow heat exchanger having a minimum thermal barrier.

It is another object to provide a recuperative heat exchanger including an annular shell and having defined therewithin a plurality of juxtaposed passages characterized by a low Reynold's number for conducting counterflowing fluids communicating across a thermal barrier of a minimal thickness.

It is another object to provide a compact heat exchanger particularly suited for systems requiring a low volume flow, a high longitudinal thermal gradient and a high achievable effectiveness.

It is another object to provide a simple lightweight, single-pass counterflow heat exchanger having increased achievable effectiveness and an increased operative life in a reactive environment.

These and other objects and advantages are achieved through an improved heat exchanger including a shell of an annular configuration, a convoluted core, formed from a sheet of minimal thickness, disposed within the shell and defining a plurality of juxtaposed, endless passages having a low Reynold's number, and a first pair of diametrically opposed manifolds mounted on the shell in communication with selected passages for simultaneously introducing into the selected passages counterflowing fluids at different temperatures, and a second pair of diametrically opposed manifolds also communicating with said passages for simultaneously extracting said fluids therefrom.

DESCRIPTION OF THE PREFERRED EMBODIMENT

Figure 1:
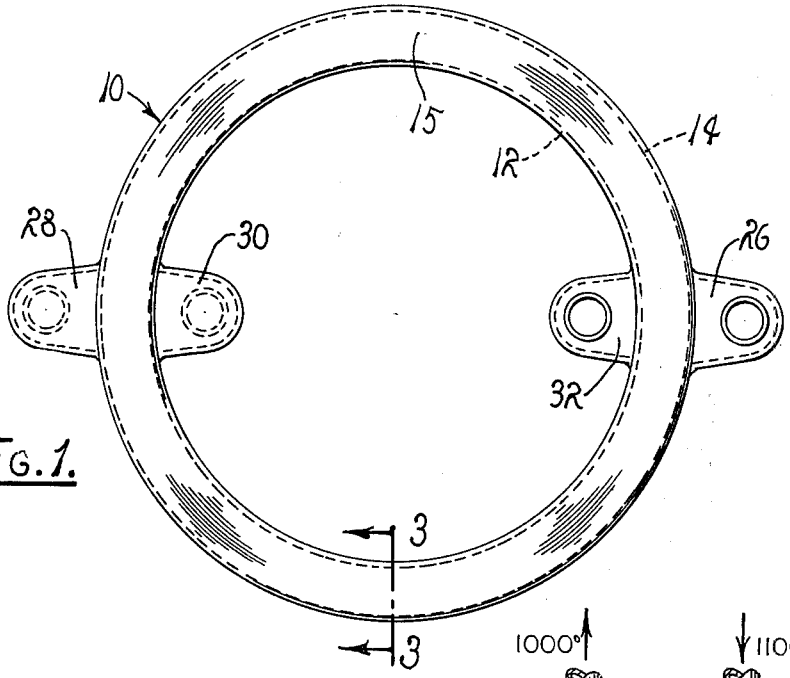
FIG. 1 is a top plan view of a heat exchanger which embodies the principles of the instant invention.
Figure 2:
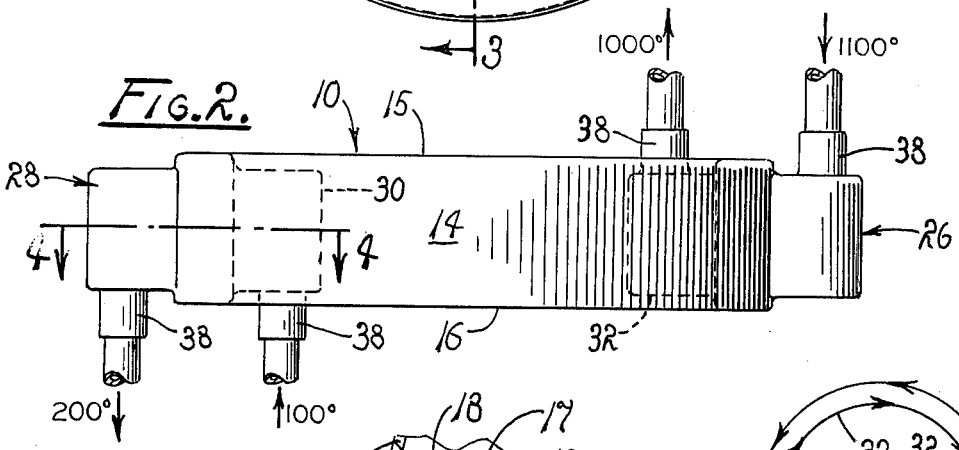
FIG. 2 is a side view of the heat exchanger shown in FIG. 1.

Referring now to the drawings wherein like reference characters designated like or corresponding parts throughout the several views, there is shown in FIG. 1 a heat exchanger which embodies the principles of the instant invention.

The heat exchanger includes a shell, generally designated 10, of an annular configuration. The shell 10 includes an inner wall 12 of a cylindrical configuration concentrically related to an outer wall 14, also of a cylindrical configuration. A pair of end plates, designated 15 and 16, is joined to the opposite ends of the walls 12 and 14 for thus defining therebetween an endless chamber, designated 17.

Figure 3:
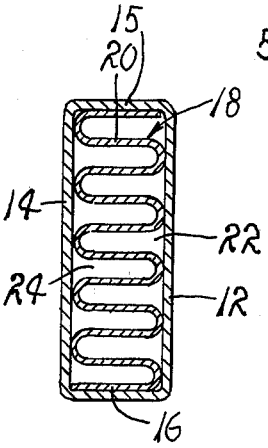
FIG. 3 is a cross-sectional view taken generally along line 3—3 of FIG. 1 illustrating juxtaposed passages defined within the heat exchanger.
Figure 4:
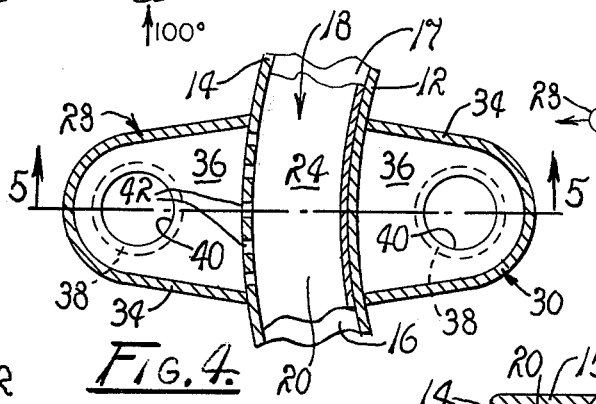
FIG. 4 is a fragmented, horizontally sectioned plan view taken generally along line 4—4 of FIG. 2.
Figure 5:
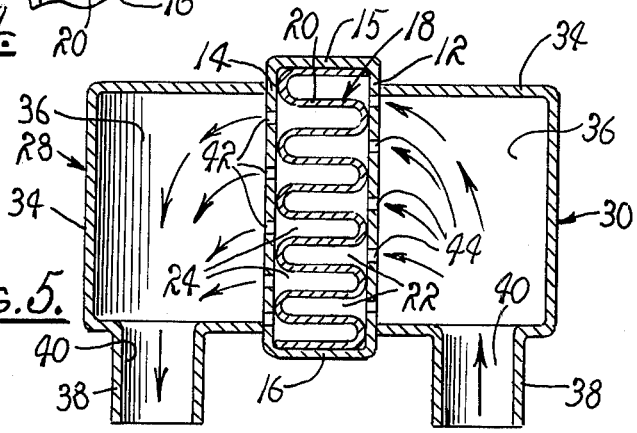
FIG. 5 is a vertically sectioned view taken generally along line 5—5 of FIG. 4.

Within the chamber 17 there is disposed an annular core, generally designated 18. The core 18, as a practical matter, comprises a uniformly convoluted plate 20, the convolutions of which serve to define a plurality of juxtaposed, endless passages, designated 22 and 24. As a practical matter, the convolutions are uniformly configured, sinuous convolutions so related that each of the passages is characterized by a substantially uniform Reynold's number throughout its depth, as best illustrated in FIGS. 3 and 5.

In order to introduce a first fluid, at a first temperature, into the shell 10, there is provided a first intake manifold 26 mounted on the outer wall 14 of the shell 10, in direct communication with the passages 24. In order to extract the first fluid from the shell 10, a first discharge manifold 28 is mounted on the periphery of the outer wall 14, also in direct communication with the passages 24. The manifolds 26 and 28 are spaced apart so that a bifurcated flow path for the first fluid is established therebetween.

A second intake manifold 30 is mounted on the wall 12 and provided for introducing a second fluid, in a cooled state, into the passages 22 of the shell 10, while a second discharge manifold 32 is mounted on the inner wall 12 in a 180 degree spaced relationship with the intake manifold 30, and serves to accommodate an extraction of the second fluid in its heated state from these passages. It should, therefore, be apparent that the manifolds 26 and 32 and the mainfolds 28 and 30 are mounted on the shell 10, in a paired relationship, in direct communication with the passages 24 and 22, respectively.

Since the manifolds 26 through 30 are of a common design, a description of manifolds 28 and 30, as hereinafter provided, is deemed adequate to provide a complete understanding of the invention. Turning now to FIG. 5 wherein there is illustrated the manifolds 28 and 30, it is noted that each of the manifolds 28 and 30 includes a manifold housing, designated 34, within which there is defined a manifold chamber 36, each being the mirror image of the other. From each of the housings 34 there is projected a nipple 38, disposed in coaxial alignment with a port 40 formed in the housing 34. As can be appreciated, the nipples 38 serve as suitable fittings through which the chambers of the manifolds 28 and 30 are, in practice, connected in communication with fluid conduits of a selected system.

Within the manifold chamber 36 of the manifold 28 the wall 14 of the shell 10 is provided with a plurality of suitably dimensioned orifices 42 through which the chamber communicates with the passages 24 of the core 18. Similarly, within the manifold chamber 36 of the intake manifold 30, the inner wall 12 of the shell is provided with a plurality of suitably dimensioned orifices 44 through which the manifold chamber communicates with the passages 22 of the core 18.

Figure 6:
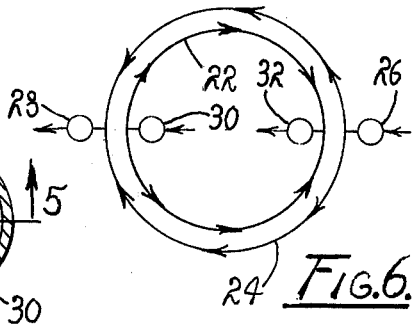
FIG. 6 is a diagrammatic view illustrating the paths for counterflowing fluids flowing through the heat exchanger.

As best illustrated by the flow diagram of FIG. 6, it can be seen that when a first fluid, at a first temperature, is introduced into the shell 10, at the intake manifold 26, the fluid is caused to flow along a bifurcated path to the discharge manifold 28. Similarly, when a second fluid is introduced into the intake manifold 30, it is cuased to flow along a bifurcated path to the discharge manifold 32. By providing a bifurcated path for the fluids, a greater single-pass flow length for a given envelope is established. Moreover, due to the sinuous configuration of the plate 20, each of the passages 22 and 24 is characterized by a substantially common low Reynold's number at substantially all regions throughout its cross section.

Further, it should be apparent that cylindrical shells accommodate the use of materials of thinner gauge than are found possible in the fabrication of shells including large flat areas. Consequently, the convoluted plate 20 can be formed of material of a relatively thin gauge so that end-to-end conduction of heat between the circumferentially spaced pairs of manifolds is substantially reduced so that an increased heat exchange effectiveness is obtainable. Moreover, due to the fact that the plate 20 is of a convoluted configuration, the surface area of welds required in forming the heat exchanger of the instant invention can be substantially reduced for thus increasing the durability and operational life span of the heat exchanger.

OPERATION

It is believed that in view of the foregoing description, the operation of the device will readily be understood and it will be briefly reviewed at this point.

With the heat exchanger of the instant invention fabricated in the manner hereinbefore described and connected within a system such as a system particularly suited for reducing $CO_2$, utilizing the Bosch reaction process, a first gas derived from a reactor, not shown, provided for the system is delivered to the intake manifold 26, at approximately 1100 degrees F. Thus, the manifold 26 serves as a hot gas manifold from which the gas is introduced into the passages 24 and caused to flow along a bifurcated path to the manifold 28. The first gas is then discharged from the discharge manifold 28 at approximately 200 degrees F., and subsequently delivered to a liquid-cooled condenser, also not shown.

Simultaneously with the flow of the first gas through the passages 24, a second gas having previously been passed through the heat exchanger is introduced into the intake manifold 30, at approximately 100 degrees F. Thus, the manifold 30 serves as a cold gas intake manifold from which the second gas passes through the inner passages 22, defined by the convolutions of the plate 20, along a bifurcated path to the discharge manifold 32. From the discharge manifold 32, the gas is returned, at approximately 1000° F. to the reactor included within the reductin system. Thus the heat exchanger of the instant invention is caused to function as a single-pass, counterflow heat exchanger.

In view of the foregoing, it should readily be apparent that the heat exchanger of the instant invention is a compact heat exchanger, formed of relatively thin materials and having a reduced number of welds, through a use of which increased achievable heat exchange effectiveness is realized.

Although the invention has been herein shown and described in what is conceived to be the most practical and preferred embodiment, it is recognized that departures may be made therefrom within the scope of the invention, which is not to be limited to the illustrative details disclosed.

It is claimed:

1. An improved Heat Exchanger comprising:

a shell of annular configuration;

a core within said shell consisting of an endless, uniformly convoluted plate, each of said convolutions contacting an outer wall of said shell thus defining a plurality of endless juxtaposed passages of uniform depth on each side of said plate within said shell;

means for introducing a first fluid at a first temperature into said passages located on one side of said plate and means for simultaneously introducing a second fluid at a second temperature less than said first temperature into said passages on the other side of said plate;

means for simultaneously extracting said first fluid at a third temperature less than said first temperature from said passages on said one side of said plate, and means for simultaneously extracting said second fluid at a fourth temperature greater than said second temperature from said passages on said other side of said plate;

each of said means for introducing and extracting said first and second fluid comprising a manifold connected to a side wall of said shell;

said manifold for introducing said first fluid being on the opposite side wall from and in substantial alignment with said manifold for extracting said second fluid to constitute a first aligned pair of manifolds;

said manifold for introducing said second fluid being on the opposite side wall from and substantially in alignment with said manifold for extracting said first fluid to constitute a second aligned pair of manifolds;

said side walls of said shell having openings therein between each of said manifolds and each of said passages located on the side of said plate served by the respective manifolds;

said first aligned pair of manifolds being separated substantially 180° from said second aligned pair of manifolds whereby a fluid introduced into a manifold and passed through said openings is immediately bifurcated with one part of said fluid flowing in one direction and the other part of said fluid flowing in the opposite direction with said separated parts merging at a manifold for extracting said fluid.

* * * * *